US010363761B2

(12) United States Patent
Roginski et al.

(10) Patent No.: US 10,363,761 B2
(45) Date of Patent: Jul. 30, 2019

(54) FLEXIBLE PACKAGING PRINTER WITH MULTIPLE PRINT LANES

(71) Applicant: inc.jet Inc., Norwich, CT (US)

(72) Inventors: Zbigniew Roginski, Rocky Hill, CT (US); Joseph Cooke, Pascoag, RI (US)

(73) Assignee: INC.JET INC., Norwich, CT (US)

( * ) Notice: Subject to any disclaimer, the term of this patent is extended or adjusted under 35 U.S.C. 154(b) by 0 days.

(21) Appl. No.: 15/707,767

(22) Filed: Sep. 18, 2017

(65) Prior Publication Data

US 2019/0084324 A1 Mar. 21, 2019

(51) Int. Cl.

| | |
|---|---|
| ***B41J 25/00*** | (2006.01) |
| ***B41J 29/02*** | (2006.01) |
| ***B41J 3/407*** | (2006.01) |
| ***B41J 3/54*** | (2006.01) |
| ***B41J 15/04*** | (2006.01) |
| ***B41J 2/175*** | (2006.01) |
| ***B41J 2/165*** | (2006.01) |

(52) U.S. Cl.

CPC ..... *B41J 25/001* (2013.01); *B41J 2/16588* (2013.01); *B41J 2/1752* (2013.01); *B41J 3/407* (2013.01); *B41J 3/543* (2013.01); *B41J 15/04* (2013.01); *B41J 29/02* (2013.01)

(58) Field of Classification Search

CPC ..... B41J 25/001; B41J 3/407; B41J 29/02

See application file for complete search history.

(56) References Cited

U.S. PATENT DOCUMENTS 6,068,367 A * 5/2000 Fabbri ..... B41J 2/14024 347/49

2013/0250000 A1* 9/2013 Yamamoto ..... B41J 2/16535 347/33

* cited by examiner

*Primary Examiner* — Henok D Legesse

(74) *Attorney, Agent, or Firm* — Baker & McKenzie LLP

(57) ABSTRACT

An imaging device or printer for depositing ink on continuously moving media, such as a film web in a vertical fill form seal machine (i.e., a stick pack machine), that allows for printing on multiple print lanes while eliminating the need for shuttling of print heads or expensive lasers. In one embodiment, plurality of print head assemblies are fixed into a grid during a print operation, whereby the grid of print head assemblies are capable of printing within multiple print lanes while the media is continuously moving, without shuttling any of the print heads.

28 Claims, 8 Drawing Sheets

FLEXIBLE PACKAGING PRINTER WITH MULTIPLE PRINT LANES

CROSS-REFERENCE TO OTHER APPLICATIONS

Not Applicable.

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND

Technical Field

The embodiments described and claimed herein relate generally to industrial imagers or printers used to print information on products in a high-volume production line. The embodiments have particular relevance and use in vertical fill form seal machines (sometimes referred to as "stick pack machines") to print information on a flexible medium or web (e.g., a film material) that comprises multiple lanes of narrow pouches designed to hold solids or liquids like sugar, coffee, honey, etc.

Background Art

Printing in a stick pack machine is typically achieved by stopping movement of the web while the bags are being sealed and, while stopped, shuttling a single print head or multiple print heads across the multiple lanes of the web. This prior art method of printing requires the use of moving parts to shuttle the print heads across multiple lanes, which are subject to wear and tear. This prior art method also requires the web to repeatedly start and stop, and the print heads to traverse the width of the web, which slows down the production rate of the stick pack machine.

SUMMARY OF THE PRESENT EMBODIMENTS

The embodiments disclosed and claimed herein solve at least some of the short-comings of the existing printers. For instance, at least some embodiments described herein can support multiple print lanes while the web continuously advances: there is no need to start and stop the movement of the web.

In one embodiment, an imaging device for depositing ink on a web may include a ski plate with an elongated opening for holding a plurality of print head assemblies in a grid defined by multiple rows and multiple print lanes. The elongated opening may have a width of at least two rows and a length spanning at least four print lanes, whereby the elongated opening is capable of simultaneously holding at least one print head assembly in each lane and at least two print head assemblies in each row. The imaging device may further comprise an engagement structure for connecting at least one print head assembly to the elongated opening of the ski plate. The engagement structure could comprise a clamp that is capable of sliding along the length of the elongated opening and being fixed at multiple positions therealong, whereby the spacing between the multiple print lanes is adjustable. The elongated opening may have a first edge that extends a length of a first row, and a second edge that is opposite from the first edge and extends a length of a last row. The clamp could comprise a top clamp and a bottom clamp that engage with the first and second edges of the elongated opening. A top and/or bottom of the ski plate may have a recessed surface adjacent the first and second edges that receives the top and/or bottom clamp, whereby the top and/or bottom clamp are flush with a top and/or bottom surface of the ski plate. The clamp may be engaged with the elongated opening in two different orientations, including a first orientation and a second orientation, the second orientation being a 180° rotation from the first orientation. The clamp may have an aperture for receiving a print nozzle of a print cartridge held by the print head assembly, the aperture being disposed adjacent one end of the clamp whereby, in the first orientation the aperture is positioned in the first row, and in the second orientation the aperture is positioned in the last row. The elongated opening may have a width of two rows, or more. The elongated opening may have a length spanning at least four print lanes, at eight print lanes, at least sixteen print lanes, or more, whereby the elongated opening is capable of simultaneously holding at least one print head assembly in each lane and at least two, four, eight, or more print head assemblies in each row, respectively. The grid of print head assemblies may be fixed and not shuttle during a printing operation. The grid of print head assemblies may be capable of printing within multiple print lanes while the web is continuously moving. The imaging device may include print head drive electronics for the print head assemblies, wherein the print head drive electronics, ski plate and print head assemblies form a single module that is connected to a machine housing by slides, whereby the module can be slid at least mostly outside of the machine housing for maintenance.

Additional embodiments are contemplate that include some combination of the features described above, below, and in the prior art.

BRIEF DESCRIPTION OF THE SEVERAL VIEWS OF THE DRAWINGS

These and other features, aspects, objects, and advantages of the embodiments described and claimed herein will become better understood upon consideration of the following detailed description, appended claims, and accompanying drawings.

Figure 1:
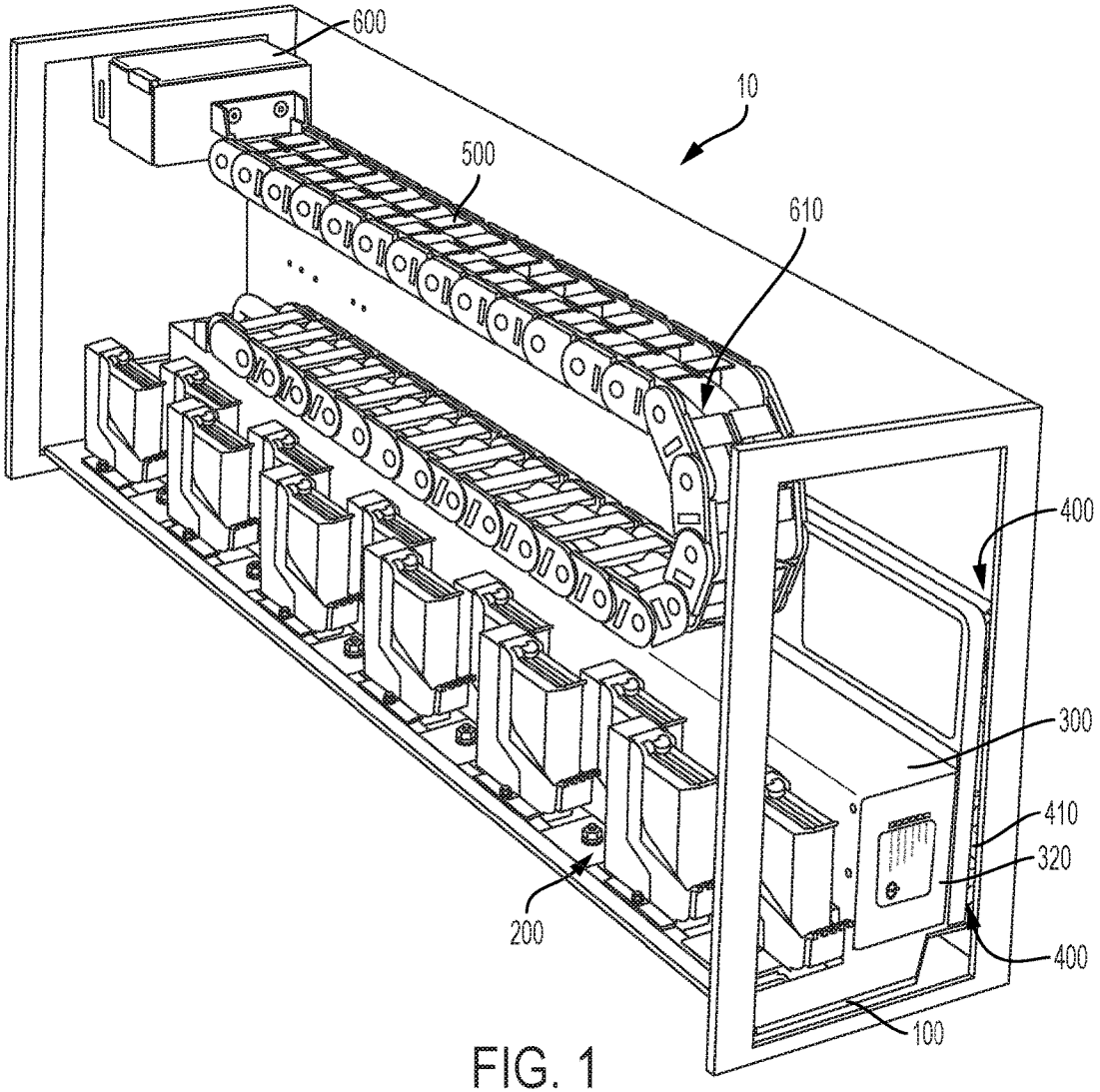
FIG. 1 is a first perspective view of a first embodiment of an imaging device installed in a machine housing and placed in a retracted, use position inside of the machine housing.

It should be understood that the drawings are not necessarily to scale and that the embodiments are sometimes illustrated by graphic symbols, phantom lines, diagrammatic representations and fragmentary views. In certain instances, details which are not necessary for an understanding of the embodiments described and claimed herein or which render other details difficult to perceive may have been omitted. It should be understood, of course, that the inventions described herein are not necessarily limited to the particular embodiments illustrated. Indeed, it is expected that persons of ordinary skill in the art may devise a number of alternative configurations that are similar and equivalent to the embodiments shown and described herein without departing from the spirit and scope of the claims.

Like reference numerals will be used to refer to like or similar parts from Figure to Figure in the following detailed description of the drawings.

DETAILED DESCRIPTION OF THE PRESENT EMBODIMENTS

An embodiment of an imaging device is depicted in FIGS. 1-8. As depicted, the imaging device is a self-contained, "drop-in" lane module 10 that includes all of the necessary hardware and printing electronics for the imaging device; no external controllers are required. The primary components of the lane module 10 include a ski plate 100, a plurality of print head assemblies 200, a housing 300 for print head drive electronics (not shown), slider mounts 400 for securing the lane module 10 to the machine housing 20, an energy chain 500, and a connector panel 600.

Figure 2:
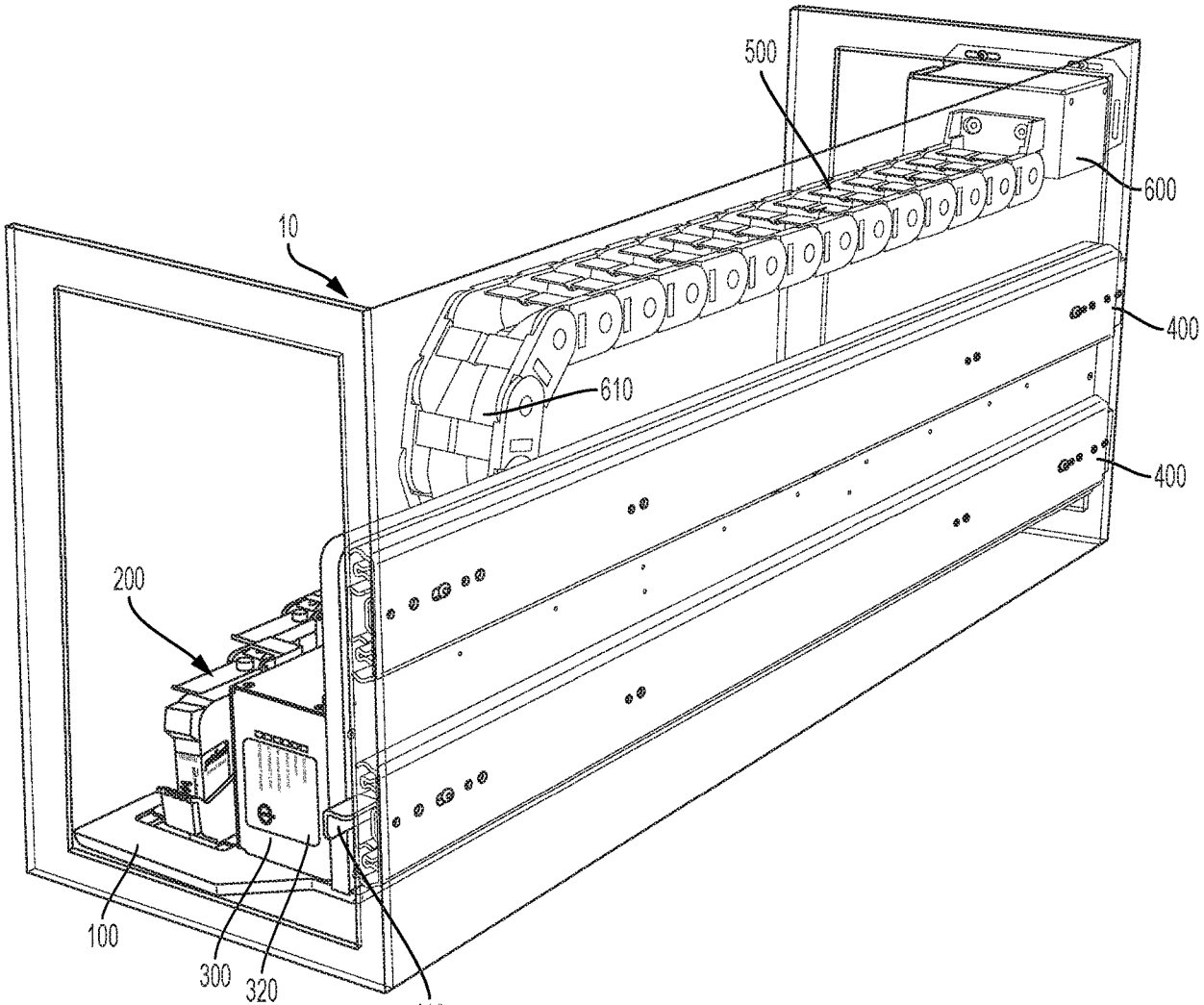
FIG. 2 is a second perspective view of the imaging device installed in a machine housing and placed in a retracted, use position inside of the machine housing.
Figure 3:
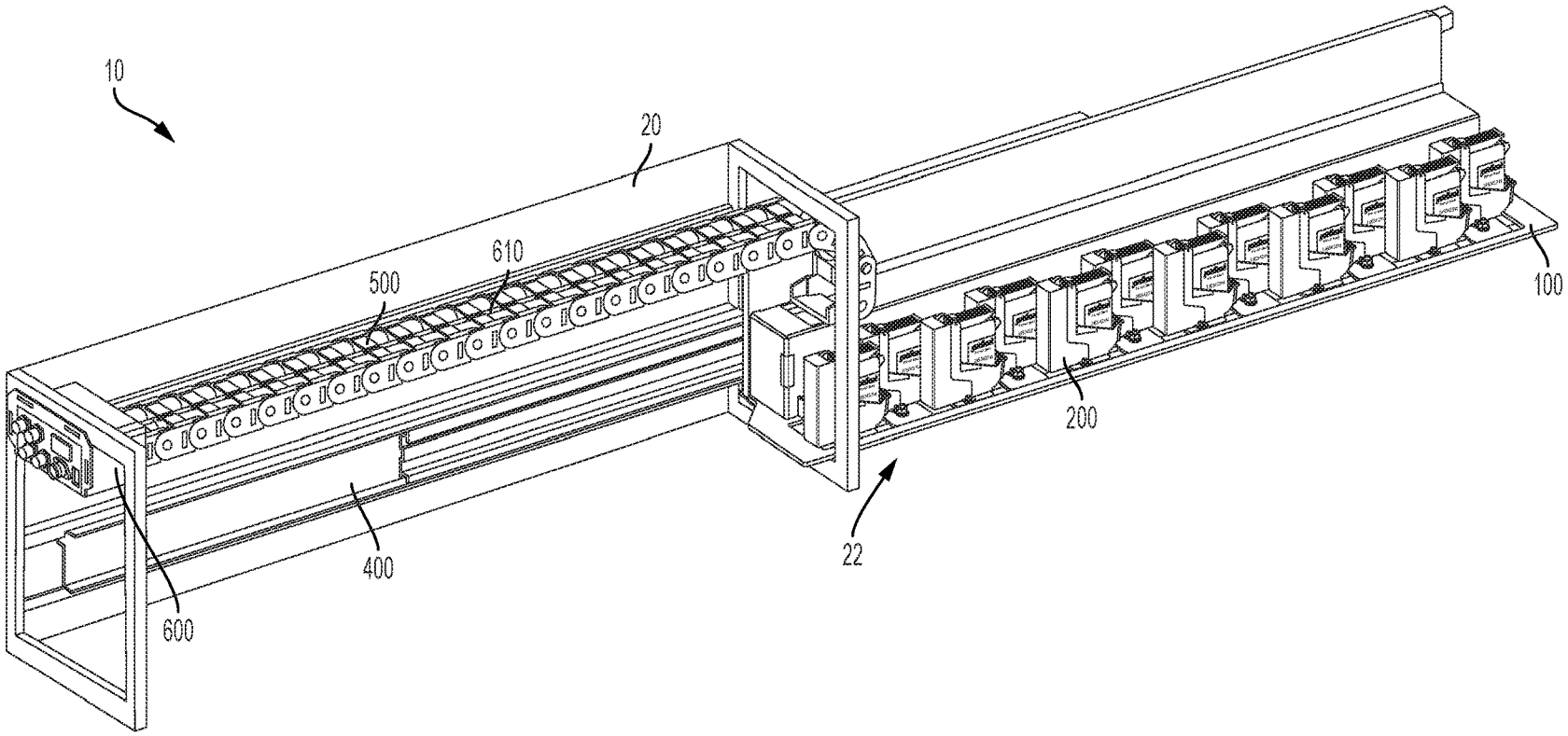
FIG. 3 is a third perspective view of the imaging device installed in a machine housing and placed in an extended, maintenance position outside of the machine housing.

As best shown in FIGS. 1-3, the lane module 10 may be secured to the machine housing 20 via slider mounts 400, such as drawer slides, whereby the lane module 10 may be easily moved between a use position and a maintenance position. In the use position, the lane module 10 is inside of the machine housing 20 (see FIGS. 1-2), in an appropriate position for receiving and printing on the print medium or web. In the maintenance position, the lane module 10 extends through the opening 22 in the machine housing 20 and is at least mostly outside of the machine housing 20, providing easy access to the imaging device components for cartridge replacement and maintenance, without having to engage in extensive disassembly of the production machine. One or more lock mechanism(s) 410 may be provided, which allow the lane module 10 to be locked or held in one or both of the use and maintenance positions.

In the depicted embodiment, the connector panel 600 is secured to the machine housing 20 so that the connector panel 600 is accessible from the outside of the machine housing 20. In alternative embodiments, the connector panel may be mounted so that it is accessible from the inside of the machine housing 20. The connector panel 600 is electrically connected to the rest of the lane module 10 via cables 610 that are disposed within and held by the energy chain 500, or other flexible cable carrier. As shown, the cables 610 and energy chain 500 interconnect the connector panel 600 to the housing 300, whereby the connector panel 600 is in electrical communication with the print head drive electronics (not shown).

The print head drive electronics disposed in the housing 300 may include a processor board (i.e., a printed circuit board) manufactured by inc.jet Incorporated, doing business as inc.jet. The processor board is a main board for the lane module 10 that is designed to command up to 4 print cartridges. Multiple processor boards can be daisy chained together in the housing 300 to command more print cartridges in a single print system. The processor board communicates with host software over Ethernet 640 to get job print templates. The processor board has three main functions: (1) Raster Image Processing to generate print data; (2) Command the print cartridge 800 through the pen driver board 250 to print the data; and (3) Accept/Output and process all the peripheral connection signals, like Print Trigger 660, Encoder 650, I/O 620, and Stack light 630.

Figure 7:
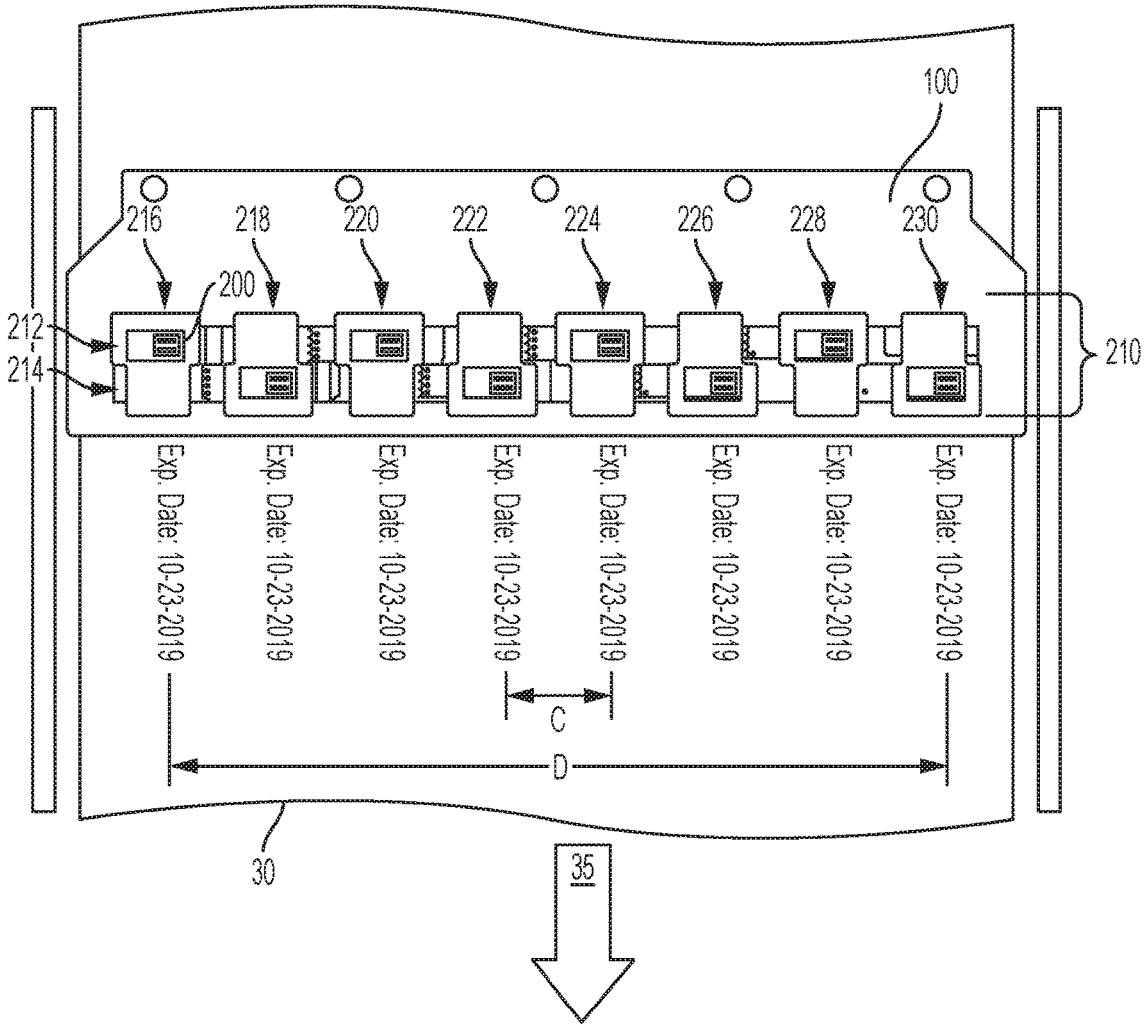
FIG. 7 is a plan view showing one intended use of the imaging device, in a vertical fill form seal machine; and, FIG. 8 is a front view of the connector panel for the imaging device.

As best shown in FIG. 7, the ski plate 100 is configured to hold print head assemblies 200 in a grid 210 having at least two rows 212, 214, which are oriented to extend from one side of the print medium or web 30 to the other side, transverse to the direction of travel 35 of the web 30, and anywhere from four to sixteen or more print lanes 216, 218, 220, 222, 224, 226, 228, 230, which are aligned with the direction of travel 35 of the web 30. As shown in FIGS. 1-3 and 7, the print head assemblies 200 alternate between the first row 212 and last row 214, which allows the print head assemblies 200 in adjacent lanes to overlap and, accordingly, the lane spacing to be decreased, in comparison to a device having a single row. It is contemplated that lane spacing can be decreased even further yet by increasing the number of rows beyond just the two rows 212, 214 shown, to three rows, four rows, or even more.

Figure 5:
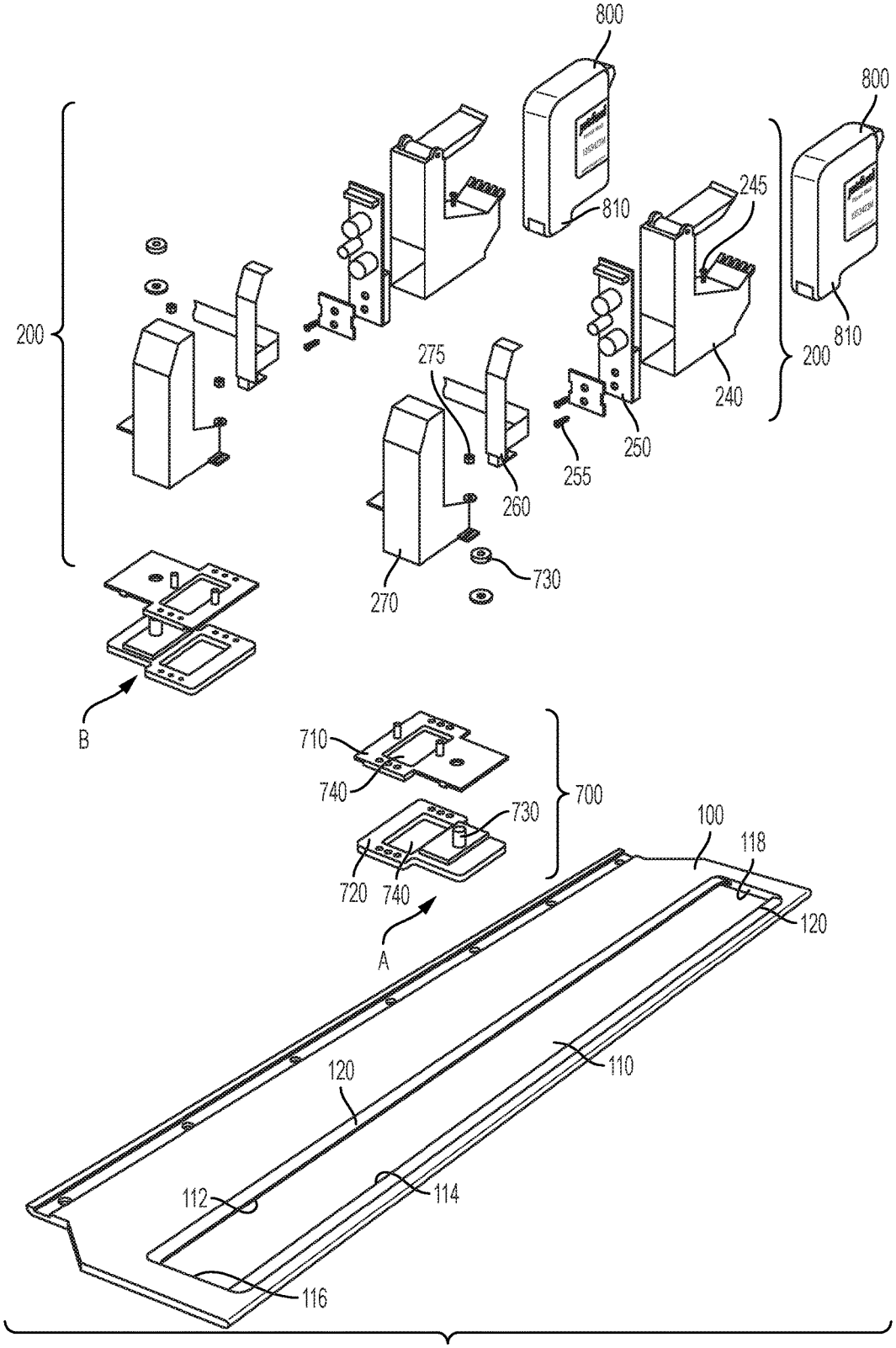
FIG. 5 is an exploded view showing the structures for mounting print head assemblies to the ski plate of the imaging device.
Figure 6:
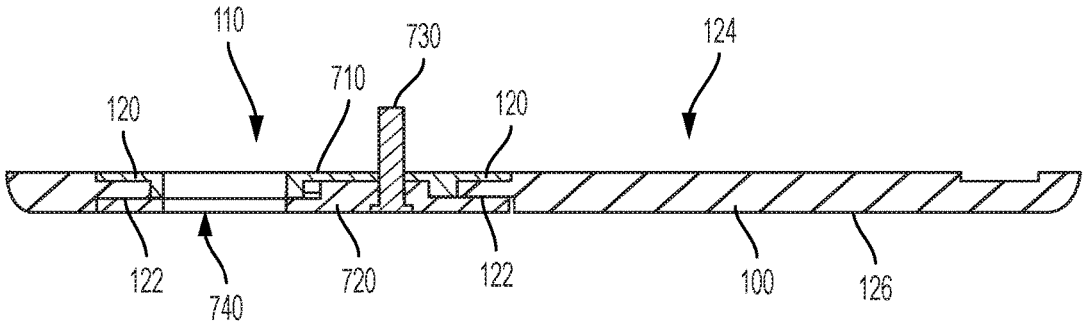
FIG. 6 is a cross-sectional view showing the structures for mounting print head assemblies to the ski plate of the imaging device.

As best shown in FIG. 5, the ski plate 100 includes an elongated opening 110 that is oriented transverse to the direction of travel of the web 30. An engagement structure 700 may be used to interconnect the print head assemblies 200 to the ski plate 100. In the depicted embodiment, the engagement structure 700 comprises a top clamp 710 and a bottom clamp 720 which are inserted above and below the opening and are held together using a fastener 730, whereby the engagement structure 700 clamps onto the ski plate 100. As can be appreciated, by loosening and tightening the fastener 730, the engagement structure 700, and the print head assembly 200 held thereby, may be easily slid or moved and subsequently fixed at any position along the length of the elongated opening 110.

The elongated opening 110 has a first edge 112 extending along the length of the elongated opening 110. The elongated opening 110 also has a second edge 114 that is opposite from and parallel to the first edge 112. The first and second edges 112, 114 are interconnected by third and fourth edges 116, 118. The top and bottom clamps 710, 720 are configured to clamp between the first and second edges 112, 114 of the elongated opening 110. The first and second edges 112, 114 have recessed surfaces 120, 122 on one or both of their upper and lower sides. The recessed surfaces 120, 122 are configured to receive the top and bottom clamps 710, 720, respectively, whereby the top and bottom clamps 710, 720 sit flush with the top and bottom surfaces 124, 126 of the ski plate 100 when properly clamped in place.

The engagement structure 700 may be universal, in that it can be manipulated to position the print head assembly 200 in one of a multiple of rows 212, 214. As shown, the engagement structure 700 includes an aperture 740 that is positioned at one end of the engagement structure 700. As best shown in FIG. 5, the engagement structure 700 has a first orientation A, where the aperture 740 is aligned with the first row 212. The engagement structure 700 may be rotated 180° to a second orientation, where the aperture is aligned with the last row 214.

The print head assembly 200, which is configured to hold a print cartridge or pen 800, is fixed above the engagement structure 700. The print head assembly 200 is aligned on the engagement structure 700, whereby the aperture 740 receives a print nozzle 810 of a print cartridge 800.

As best shown in FIG. 5, the print head assembly 200 comprises a pen stall 240, a pen driver board 250, a ribbon cable 260, and an electronics cover 270. The pen stall 240 may be secured to the engagement structure 700 via fasteners 245 and is configured to hold the print cartridge 800. The pen driver board 250 may be secured to the pen stall 240 via fasteners 255. A pen driver board manufactured by HP as part number C8855M may be used. The pen driver board 250 provides the logic interface between the processor board and the printer cartridge 800. It converts serial print data sent from the processor board to specific firing signals to drive the print cartridge 800. The ribbon cable 260 is configured to pass through an opening 310 in the side of housing 300 and to connect the pen driver board 250 to the print head drive electronics (i.e., the processor board) disposed in housing 300. The electronics cover 270 may be secured to the engagement structure 700 via fasteners 275 and is designed to cover and protect the ribbon cable 260 and pen driver board 250.

Figure 4:
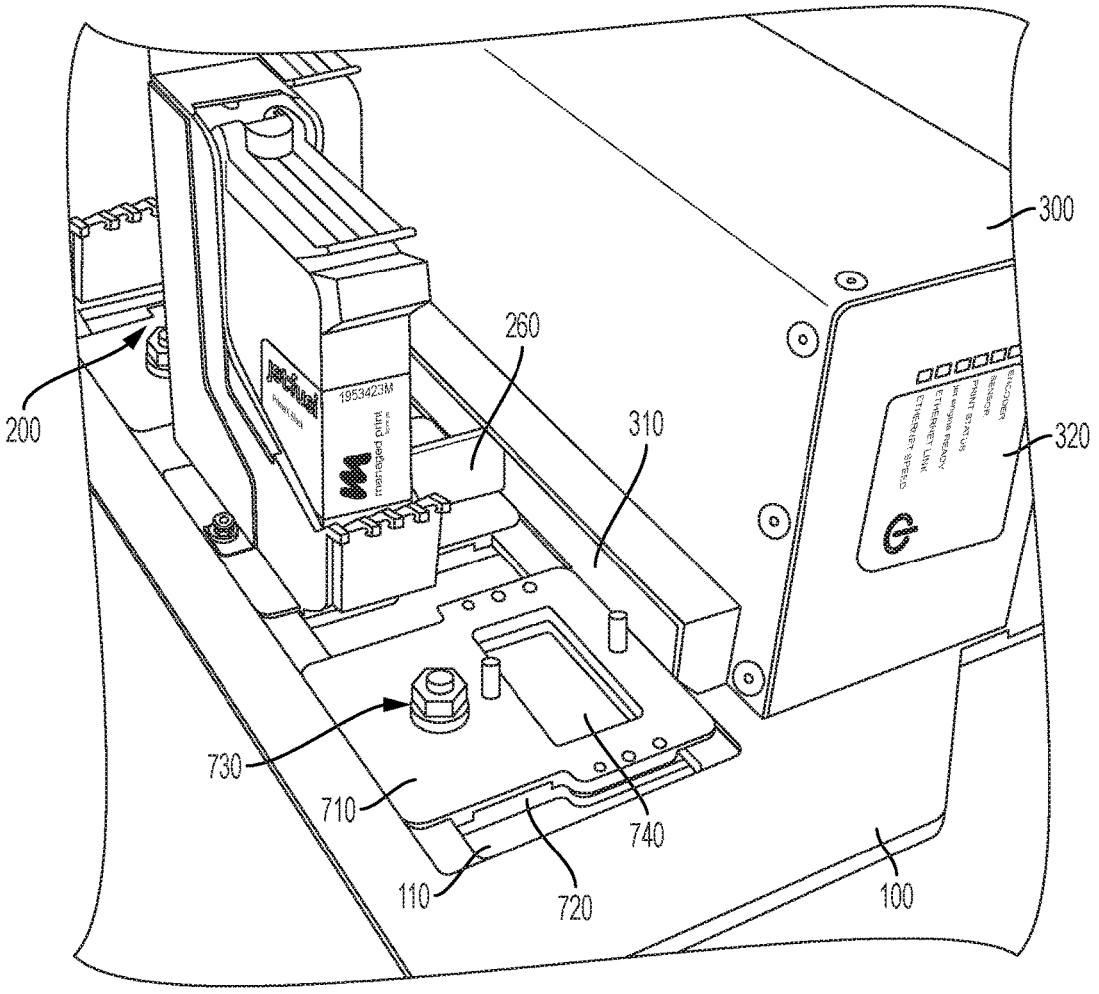
FIG. 4 is a close up perspective view showing the structures for mounting print head assemblies to the ski plate of the imaging device, and showing the status display for the imaging device.

Turning now to FIG. 4, the lane module includes a status display 320 that may be positioned at an end of the housing 300, where it may be visible through an opening 22 of the machine housing 20. The status display includes indicators such as colored or blinking LED lights, that provide at least the following indications: whether the encoder is inactive or pulsing; whether a sensor detects product or not; whether the imager is idle, ready to print, printing, or in an error state; whether the jet.engine is configured (i.e., to indicate if the printer booted up correctly and is operational); the status of the network connection and network activity.

Figure 8:
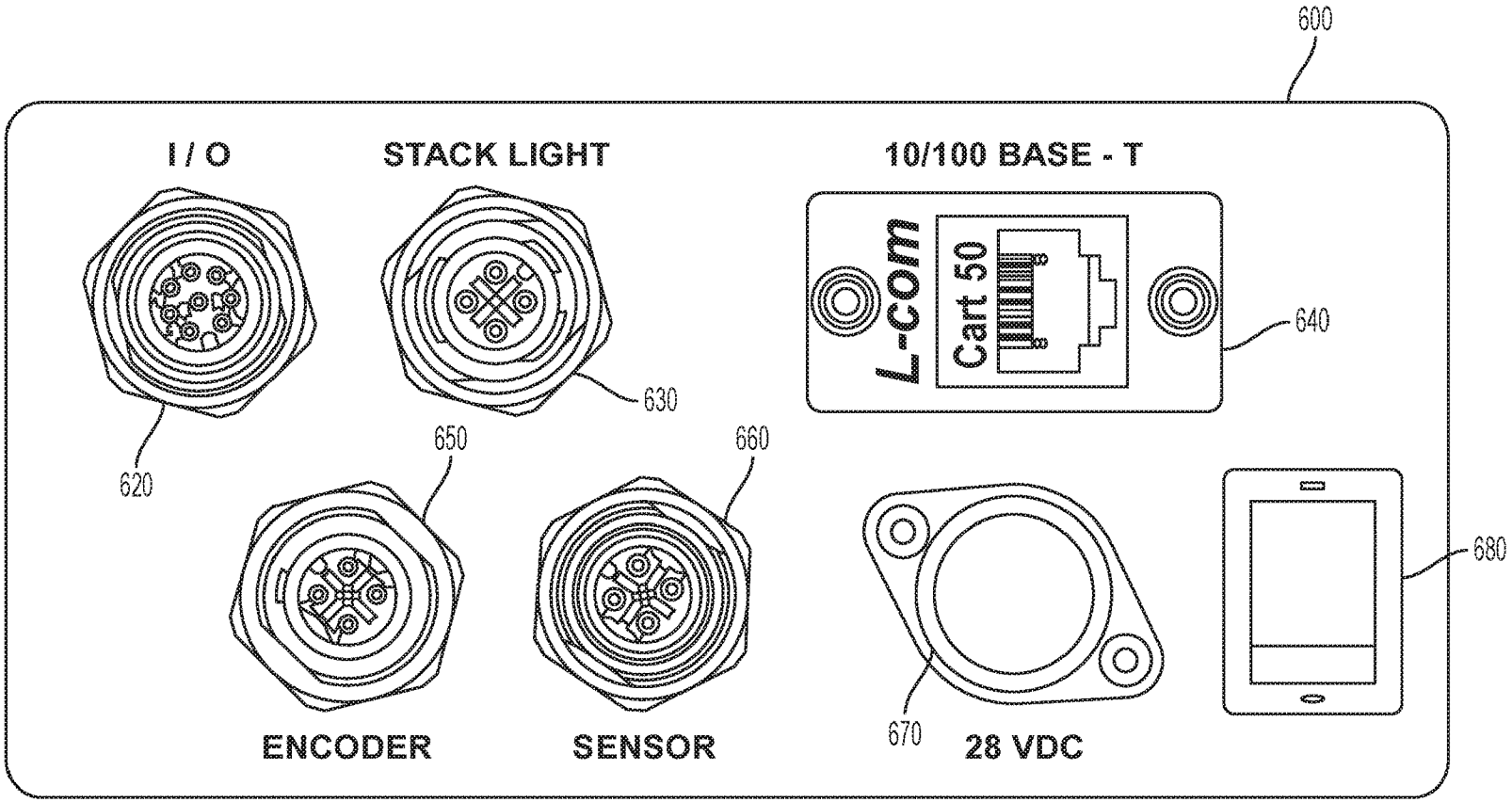

Turning now to FIG. 8, the control panel 600 includes: an input/output connector 620, providing a discrete I/O port that could be connected to the VFFS machine for the purpose of providing status and controls (e.g., starting and stopping print jobs and indicating errors and warning states, like out of ink); a stack light connector 630 for connecting to a stack light kit (for example, inc.jet part no. 5019315G) that provides an LED-illuminated status indication that can be seen in the vicinity of the production machine; a 10/100 BASE-T connector 640 for Ethernet communications with the host application over the network to receive print jobs or print templates (host application could also be touchscreen user interfaces that could be used as user terminals to control the printing system); an encoder connector 650 for connecting an encoder (for example, inc.jet part no. 50020082G) which provides an indication of the speed of movement of the web 30; a sensor connector 660 for connecting to a photocell sensor which provides an indication of when product is passing by the imaging device; a power connector 670; and a power switch 680.

It is contemplated that the imaging device described above and shown in the figures may be bolted into almost any VFFS machine, regardless of seal type, whether pillow, gusseted, flat bottom, or quad seal. It is designed to be highly configurable, allowing for printing in multiple print lanes without shuttling print heads or expensive laser systems. The embodiment shown in FIGS. 1-9 is depicted with eight print lanes 216, 218, 220, 222, 224, 226, 228, 230 and a lane spacing C. However, any number of the print head assemblies 200 may be removed, where the shown embodiment may be reconfigured to have anywhere from one to eight lanes, with a lane spacing anywhere between a minimum C and a maximum D. Alternative embodiments of the imaging device may have a ski plate that is longer or shorter than the depicted embodiment. For instance, a second embodiment may have a ski plate that may be configured to have anywhere from one to four print lanes. A third embodiment may have a ski plate that may be configured to have anywhere from one to twelve lanes. A fourth embodiment may have a ski plate that may be configured to have anywhere from one to sixteen lanes.

Although the inventions described and claimed herein have been described in considerable detail with reference to certain embodiments, one skilled in the art will appreciate that the inventions described and claimed herein can be practiced by other than those embodiments, which have been presented for purposes of illustration and not of limitation. Therefore, the spirit and scope of the appended claims should not be limited to the description of the embodiments contained herein.

We claim:

1. An imaging device for depositing ink on a web, the imaging device comprising:

a ski plate having an elongated opening configured to hold a plurality of print head assemblies in a grid defined by multiple rows and multiple print lanes, the elongated opening having a width of at least two rows and a length spanning at least four print lanes, and the elongated opening is configured to simultaneously hold at least one print head assembly in each lane and at least two print head assemblies in each row; and an engagement structure configured to couple at least one print head assembly to the elongated opening of the ski plate at multiple positions along the elongated opening whereby a spacing between the multiple print lanes is adjustable.

2. The imaging device of claim 1, wherein, the engagement structure includes a clamp configured to slide along the length of the elongated opening and be fixed at multiple positions along the elongated opening.

3. The imaging device of claim 2, wherein:

the elongated opening has a first edge that extends a length of a first row, and a second edge that is opposite from the first edge and extends a length of a last row, the clamp includes a top clamp and a bottom clamp that respectively engage with the first and second edges of the elongated opening, and a bottom of the ski plate has a recessed surface adjacent the first and second edges that receives the bottom clamp, whereby the bottom clamp is flush with a bottom surface of the ski plate.

4. The imaging device of claim 3, wherein the clamp is configured to engage with the elongated opening in a first orientation or a second orientation, the second orientation being a 180° rotation from the first orientation, and the clamp has an aperture configured to receive a print nozzle of a print cartridge held by the print head assembly, the aperture being disposed proximal an end of the clamp, in the first orientation the aperture is positioned in the first row, and in the second orientation the aperture is positioned in the last row.

5. The imaging device of claim 4, wherein the elongated opening has a width of two rows.

6. The imaging device of claim 1, wherein the elongated opening has a length spanning at least eight print lanes, and the elongated opening is configured to simultaneously hold at least one print head assembly in each lane and at least four print head assemblies in each row.

7. The imaging device of claim 1, wherein the elongated opening has a length spanning at least sixteen print lanes, and the elongated opening is configured to simultaneously hold at least one print head assembly in each lane and at least eight print head assemblies in each row.

8. The imaging device of claim 1, wherein the grid of print head assemblies is fixed and does not shuttle during a printing operation and is configured to print in the multiple print lanes while the web is continuously moving.

9. The imaging device of claim 1, further comprising print head drive electronics, wherein the print head drive electronics, ski plate and print head assemblies form a module that is coupled to a housing by a slide, and the module is configured to slide outside of the machine housing to provide access to the print head assemblies.

10. An imaging device for depositing ink on a web, the imaging device comprising:

a housing;

a plurality of print head assemblies organized into a grid spanning multiple print lanes and multiple rows, the plurality of print head assemblies coupled to the housing by a slide, wherein in a first position of the slide, the print head assemblies are disposed in the housing, in a second position of the slide, the print head assemblies are disposed outside the housing to provide access to replace the print head assemblies, and the grid of print head assemblies is fixed and does not shuttle during a printing operation and is configured to print in the multiple print lanes while the media is continuously moving.

11. The imaging device of claim 10, further comprising a ski plate having an elongated opening configured to hold the plurality of print head assemblies in the grid, wherein the elongated opening has a width of at least two rows and a length spanning at least four print lanes, and the elongated opening is configured to simultaneously hold at least one print head assembly in each lane and at least two print head assemblies in each row.

12. The imaging device of claim 11, further comprising an engagement structure configured to couple at least one print head assembly to the elongated opening of the ski plate, the engagement structure including a clamp that is configured to slide along the length of the elongated opening and be fixed at multiple positions along the elongated opening, whereby a spacing between the multiple print lanes is adjustable.

13. The imaging device of claim 12, wherein the elongated opening has a first edge that extends a length of a first row, and a second edge that is opposite from the first edge and extends a length of a last row, the clamp includes a top clamp and a bottom clamp that respectively engage with the first and second edges of the elongated opening, and a bottom of the ski plate has a recessed surface adjacent the first and second edges that receives the bottom clamp, whereby the bottom clamp is flush with a bottom surface of the ski plate.

14. The imaging device of claim 13, wherein the clamp is configured to engage with the elongated opening in a first orientation or a second orientation, the second orientation being a rotation from the first orientation; and the clamp has an aperture configured to receive a print nozzle of a print cartridge held by the print head assembly, the aperture being disposed proximal an end of the clamp, in the first orientation the aperture is positioned in the first row, and in the second orientation the aperture is positioned in the last row.

15. The imaging device of claim 14, wherein the elongated opening has a width of two rows.

16. The imaging device of claim 10, wherein the grid has a width of at least two rows and a length spanning at least four print lanes, and the grid includes at least one print head assembly in each lane and at least two print head assemblies in each row.

17. The imaging device of claim 10, wherein the grid has a length spanning at least eight print lanes, and the grid includes at least one print head assembly in each lane and at least four print head assemblies in each row.

18. The imaging device of claim 10, wherein the grid has a length spanning at least sixteen print lanes, and the grid includes at least one print head assembly in each lane and at least eight print head assemblies in each row.

19. The imaging device of claim 10, further comprising print head drive electronics.

20. An imaging device for depositing ink on a web, comprising:

a housing;

a ski plate having an elongated opening configured to hold a plurality of print head assemblies into a grid defined by multiple rows and multiple print lanes; and an electronic drive component configured to move the ski plate between a first position and a second position, wherein in the first position, the print head assemblies are disposed in the housing, and in the second position, the print head assemblies are disposed outside the housing to provide access to replace the print head assemblies.

21. The imaging device of claim 20, wherein the elongated opening has a width of at least two rows and a length spanning at least four print lanes, whereby the elongated opening is configured to simultaneously hold at least one print head assembly in each lane and at least two print head assemblies in each row.

22. The imaging device of claim 21, further comprising engagement structure configured to couple at least one print head assembly to the elongated opening of the ski plate, the engagement structure including a clamp that is configured to slide along the length of the elongated opening and be fixed at multiple positions along the elongated opening, whereby a spacing between the multiple print lanes is adjustable.

23. The imaging device of claim 22, wherein the elongated opening has a first edge that extends a length of a first row, and a second edge that is opposite from the first edge and extends a length of a last row, the clamp includes a top clamp and a bottom clamp that respectively engage with the first and second edges of the elongated opening, and a bottom of the ski plate has a recessed surface adjacent the first and second edges that receives the bottom clamp, whereby the bottom clamp is flush with a bottom surface of the ski plate.

24. The imaging device of claim 23, wherein the clamp is configured to engage with the elongated opening in a first orientation or a second orientation, the second orientation being a rotation from the first orientation; and the clamp has an aperture configured to receive a print nozzle of a print cartridge held by the print head assembly, the aperture being disposed proximal an end of the clamp, in the first orientation the aperture is positioned in the first row, and in the second orientation the aperture is positioned in the last row.

25. The imaging device of claim 24, wherein the elongated opening has a width of two rows.

26. The imaging device of claim 21, wherein the elongated opening has a length spanning at least eight print lanes, and the elongated opening is configured to simultaneously hold at least one print head assembly in each lane and at least four print head assemblies in each row.

27. The imaging device of claim 21, wherein the elongated opening has a length spanning at least sixteen print lanes, and the elongated opening is configured to simultaneously hold at least one print head assembly in each lane and at least eight print head assemblies in each row.

28. The imaging device of claim 21, wherein the grid of print head assemblies is fixed and does not shuttle during a printing operation and is configured to print in the multiple print lanes while the web is continuously moving.

* * * * *